United States Patent [19]

Fruchard

[11] 4,247,159

[45] Jan. 27, 1981

[54] ELECTRICAL CONNECTOR FOR USE IN ESTABLISHING TAP CONNECTIONS

[75] Inventor: Charles Fruchard, Conflans-Sainte Honorine, France

[73] Assignee: AMP Incorporated, Harrisburg, Pa.

[21] Appl. No.: 54,724

[22] Filed: Jul. 5, 1979

[30] Foreign Application Priority Data

Jul. 24, 1978 [FR] France ..... 78 21877

[51] Int. Cl.[3] ..... H01R 4/44

[52] U.S. Cl. ..... 339/95 R; 339/246

[58] Field of Search ..... 339/95–99, 339/253 L, 255 L, 263 L, 264 L, 265 F, 266 L

[56] References Cited

U.S. PATENT DOCUMENTS 3,431,538 3/1969 Hubbard et al. ..... 339/246 X

*Primary Examiner*—Neil Abrams
*Assistant Examiner*—John S. Brown
*Attorney, Agent, or Firm*—David C. Ripma

[57] ABSTRACT

An electrical connector for use in making tap connections to conductors, comprises a two part (1, 2) housing carrying two contact member arrangements (8, 9, 12) and a bolt (3) by which the housing parts (1, 2) can be urged together thereby to close the contact arrangements (8, 9, 12) onto a suitably positioned conductor and tap wire, the contact arrangements (8, 9, 12) being such that connection can be made to the conductor before it is necessary to position the tap wire for connection.

2 Claims, 3 Drawing Figures

ELECTRICAL CONNECTOR FOR USE IN ESTABLISHING TAP CONNECTIONS

This invention relates to an electrical connector, and particularly to an electrical connector for use in establishing tap connections such as earth connections to electrical conductors.

An electrical connector for such a purpose is known, which comprises a body of electrically insulating material, the body being in two parts secured together by means of a bolt by means of which the two parts of the body can be urged towards each other, and two electrical contact members carried by the two body parts respectively, each contact member having two contact portions directed towards the contact portions of the other contact member respectively, each contact portion being in the form of a plurality of teeth arranged to bite into a conductor positioned between a contact portion and the associated contact portion of the other contact member as the two parts of the body are urged towards each other by means of the bolt.

For use of this known connector a conductor to be tapped is positioned between one pair of opposed contact portions of the contact members, and a tap wire is positioned between the other pair of opposed contact portions. The bolt is then tightened to urge the two parts of the body towards each other, this causing the teeth of the contact portions to bite into the conductor and tap wire, the contact members thus establishing an electrical and mechanical connection between the conductor and the tap wire.

A difficulty which arises with the known connector is that as the bolt is tightened both pairs of opposed contact portions close together simultaneously, and thus it is necessary to position both the conductor and the tap wire between the contact portions before beginning to tighten the bolt, this being a difficult operation, particularly when a connection is being made to an overhead conductor, since it is necessary to hold both the connector and the tap wire in position while also tightening the bolt.

According to this invention in such a known connector the two contact members are integrally formed connected by a substantially U-shaped connecting portion having one free end connected to one of the contact members adjacent one of the contact portions thereof, and the other free end connected to the other contact member adjacent one of the contact portions thereof, the contact members and the connecting portion all being co-planar; and the holes in the two parts of the body through which the bolt passes are elongate in the direction parallel to the plane of the contact members and connecting portion.

The connector of this invention has the advantage that as the bolt is initially tightened to urge the two parts of the body towards each other, one pair of opposed contact portions, this being the pair adjacent which the free ends of the connecting portion are connected, will close together before the other pair, with the two parts of the body tilting relative to each other on the bolt, this because of the differential resistance to closing between the two pairs of opposed contact portions, provided by the U-shaped form of the connecting portion joining the contact members. Thus, the conductor to be tapped can be positioned between the contact portions of this first-to-close pair, and the bolt then tightened to secure the connector to the conductor. The connector will then be supported by the conductor while the tap wire is positioned between the still open other pair of opposed contact portions, and the bolt then further tightened to establish connection to the tap wire as necessary. The elongate form of the holes in the two body parts, through which the bolt passes, permits the necessary tilting of the two body parts relative to each other on the bolt mentioned above.

Preferably the two parts of the body carry two pairs of contact members, the contact members of each pair being joined by a connecting portion as specified, with the pairs being located in parallel planes on opposite sides of the bolt with the connecting portions directed in the same direction.

Such a connector ensures reliable connection to the conductor and tap wire by providing four points of contact to each thereof.

An electrical connector according to this invention will now be described by way of example with reference to the drawings, in which.

Figure 1:
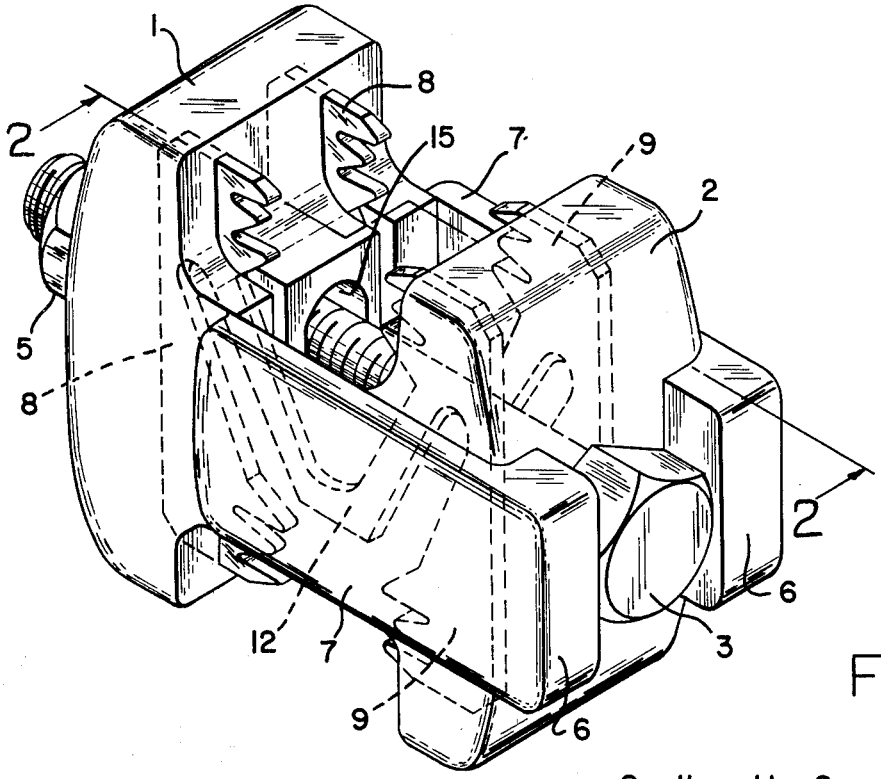
FIG. 1 is a perspective view of the connector.

The connector comprises a body of electrically insulating material, the body consisting of two moulded parts 1 and 2 secured together by means of a bolt 3 having a washer 4 and a nut 5 mounted thereon. By tightening the nut 5 on the bolt 3 the two parts 1 and 2 of the body can be urged towards each other, the part 2 being formed with a pair of opposed flanges 6 which engage opposite flats on the head of the bolt 3 to prevent rotation thereof relative to the body parts 1 and 2 as the nut 5 is tightened. The body part 2 is also formed with a pair of arms 7 which extend towards and embrace the body part 1.

Figure 3:
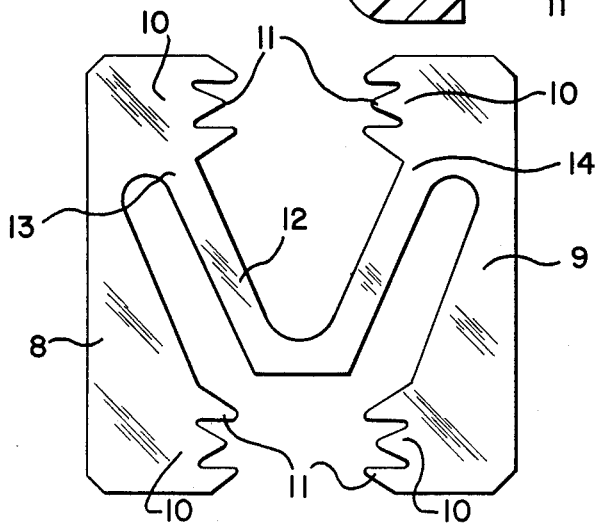
FIG. 3 is a side elevational view of a contact member arrangement used in the connector.

Located in slots in the body parts 1 and 2 are two pairs of opposed contact members 8 and 9, each contact member 8 or 9 having two contact portions 10 (see FIG. 3) directed towards the contact portions 10 of the other contact member 9 or 8 of the pair, each contact portion 10 being in the form of a plurality of teeth 11.

The two contact members 8 and 9 of each pair are integrally formed by stamping from sheet metal, connected by a substantially U-shaped connecting portion 12 having one free end 13 connected to the contact member 8 adjacent one of the contact portions 10 thereof, and the other free end 14 connected to the contact member 9 adjacent one of the contact portions 10 thereof, the contact members 8 and 9, and the connecting portion 12 all being co-planar.

The two contact member arrangements each consisting of two contact members 8 and 9, and the joining connecting portion 12, are located in parallel planes on opposite sides of the bolt 3 with the connecting portions 12 directed in the same direction.

Figure 2:
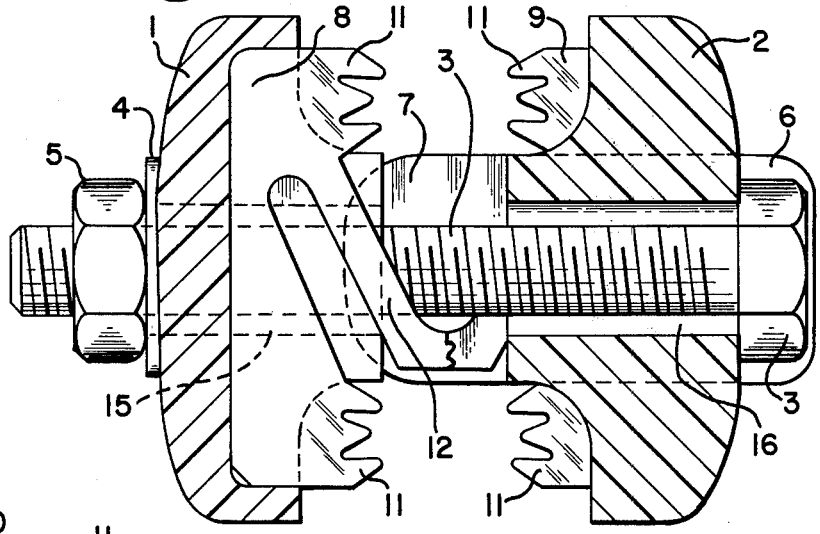
FIG. 2 is a sectional view on the line II—II in FIG. 1.

The holes 15 and 16 in the body parts 1 and 2 respectively, through which the bolt 3 passes are elongate in the direction parallel to the planes of the contact member arrangements (as best seen in FIG. 2) whereby the body parts 1 and 2 can tilt relative to each other on the bolt 3.

Due to the form of the connection portion 12 of each contact member arrangement there is a differential resistance to closing between the two pairs of opposed contact portions 12 of each contact member arrangement as the nut 5 is tightened on the bolt 3, the pair adjacent which the free ends 13 and 14 of the connecting portion 12 are connected being closed more easily, and thus before the other pair.

For use of the connector a conductor (not shown) to be tapped is positioned between the two first-to-close pairs of opposed contact portions 10 (these being the upper pairs in FIG. 2) and the nut 5 is tightened on the bolt 3 until the teeth 11 of these contact portions 10 bite into the conductor. The connector will then be supported by the conductor. A tap wire (not shown) is then positioned between the other two pairs of opposed contact portions 10 and the nut 5 then further tightened on the bolt 3 until the teech 11 of these other contact portions 10 bite into the tap wire, whereby an electrical and mechanical connection is established between the conductor and the tap wire.

What is claimed is:

1. An electrical connector comprising a body of electrically insulating material, the body being in two parts secured together by means of a bolt by means of which the two parts of the body can be urged towards each other, and two electrical contact members carried by the two body parts respectively, each contact member having two contact portions directed towards the contact portions of the other contact member respectively, each contact portion being in the form of a plurality of teeth arranged to bite into a conductor positioned between a contact portion and the associated contact portion of the other contact member as the two parts of the body are urged towards each other by means of the bolt, in which the two contact members are integrally formed connected by a substantially U-shaped connecting portion having one free end connected to one of the contact members adjacent one of the contact portions thereof, and the other free end connected to the other adjacent one of the contact portions thereof, the contact members and the connecting portion all being co-planar; and in which the holes in the two parts of the body through which the bolt passes are elongate in the direction parallel to the plane of the contact members and connecting portion.

2. A connector as claimed in claim 1, in which the body carries two pairs of contact members, the contact members of each pair being joined by a connecting portion, with the pairs being located in parallel planes on opposite sides of the bolts with the connecting portions directed in the same direction.

* * * * *